US008469453B1

(12) United States Patent
Larocque

(10) Patent No.: US 8,469,453 B1
(45) Date of Patent: Jun. 25, 2013

(54) METHOD AND APPARATUS FOR FOOT REST

(76) Inventor: Robert R. Larocque, Redwood Meadows (CA)

( * ) Notice: Subject to any disclaimer, the term of this patent is extended or adjusted under 35 U.S.C. 154(b) by 0 days.

(21) Appl. No.: 13/438,981

(22) Filed: Apr. 4, 2012

(51) Int. Cl.
*A47C 16/02* (2006.01)

(52) U.S. Cl.
USPC ..... 297/423.44; 297/423.41

(58) Field of Classification Search
USPC ..... 297/423.41, 423.44; 248/146, 163.2, 248/176.1, 440, 440.1
See application file for complete search history.

(56) References Cited

U.S. PATENT DOCUMENTS

| | | | | | |
|---|---|---|---|---|---|
| 863,541 | A | | 8/1907 | La Londe | 297/423.14 |
| 1,189,056 | A | | 6/1916 | Carry | 15/265 |
| 1,265,609 | A | | 5/1918 | Carry | 15/265 |
| 1,310,108 | A | | 7/1919 | Wanner, Jr. | 297/423.14 |
| 1,316,336 | A | | 9/1919 | Shlivek | 15/265 |
| 1,767,708 | A | | 6/1930 | Simpson | 297/188.03 |
| D148,632 | S | | 2/1948 | Martin | 426/630 |
| 2,576,883 | A | | 11/1951 | Koski | 248/126 |
| 2,850,081 | A | | 9/1958 | Dillon | 248/397 |
| 2,969,829 | A | | 1/1961 | Leroy | 297/217.2 |
| 3,667,803 | A | * | 6/1972 | Ford | 297/119 |
| 4,064,580 | A | | 12/1977 | Ezekoye | 5/652 |
| 4,131,196 | A | * | 12/1978 | Csutor | 206/278 |
| 4,394,042 | A | * | 7/1983 | Smith | 294/163 |
| 4,813,742 | A | | 3/1989 | Cardinael | 297/423 |
| 4,991,908 | A | | 2/1991 | Krechel | 297/423 |
| 5,120,108 | A | * | 6/1992 | Watson et al. | 297/188.2 |
| 5,584,535 | A | | 12/1996 | Jacobson | 297/423.46 |
| 5,678,742 | A | * | 10/1997 | Lindauer | 224/454 |
| 6,113,182 | A | * | 9/2000 | Wise | 297/119 |
| D479,407 | S | * | 9/2003 | Waybrant et al. | D6/349 |
| 6,846,043 | B1 | | 1/2005 | Leoutsakos | 297/423.46 |
| 7,048,331 | B2 | | 5/2006 | Saakyan | 297/16.1 |
| 7,644,810 | B2 | * | 1/2010 | Duncan | 190/8 |
| 7,744,047 | B2 | * | 6/2010 | Thorn | 248/176.3 |
| 2009/0102267 | A1 | | 4/2009 | Larocque | 297/423.44 |
| 2012/0175923 | A1 | * | 7/2012 | Damrow | 297/188.08 |

FOREIGN PATENT DOCUMENTS

| | | |
|---|---|---|
| GB | 2231784 | 11/1990 |

* cited by examiner

*Primary Examiner* — David Dunn
*Assistant Examiner* — Tania Abraham
(74) *Attorney, Agent, or Firm* — Walter J. Tencza, Jr.

(57) ABSTRACT

An apparatus is provided having a member, a first support, and a second support. The first support may be connected to, and hold up, a first end of the member, and the second support may be connected to, and hold up a second end of the member. The member may have a top surface and a bottom surface. There may be a slot running along the top surface of the member. The slot may be configured so that a blade of a skate fits snugly into the slot. The apparatus may further include a plurality of devices, which connect the first support with the second support. The member may be disconnected from the first support and from the second support and placed in either a right side up state in which the top surface is showing or in an upside down state in which the bottom surface is showing.

10 Claims, 12 Drawing Sheets

METHOD AND APPARATUS FOR FOOT REST

FIELD OF THE INVENTION

This invention relates to improved methods and apparatus concerning foot rests.

BACKGROUND OF THE INVENTION

There are various devices known in the prior art for foot rests.

SUMMARY OF THE INVENTION

One or more embodiments of the present apparatus provides a member having a first end and a second end. The apparatus may also include a first support, and a second support. The first support may be connected to the first end of the member and may hold up the first end of the member. The second support may be connected to the second end of the member and may hold up the second end of the member. The member may have a top surface and a bottom surface. There may be a slot running along the top surface of the member. The slot may be configured so that a blade of a skate fits snugly into the slot.

The apparatus may further include a plurality of devices, such as rods, which connect the first support with the second support. The member may be configured to be disconnected from the first support and from the second support and placed in either a right side up state in which the top surface is showing or in an upside down state in which the bottom surface is showing.

A method is also provided, which includes placing a member in a right side up state, connecting a first end of the member and supporting the first end of the member with a first support, and connecting a second end of the member and supporting the second end of the member with a second support. The member may be configured as previously described. The method may further include connecting the first support with the second support with a plurality of devices, such as rods. The method may include disconnecting the member from the first support and from the second support; and placing the member in an upside down state in which the bottom surface is showing and the slot is not facing upwards. The method may further include placing the blade of the skate in the slot and resting the skate on the member. The method may further include tying laces of the skate. The method may include tying laces of a shoe while the shoe rests on the bottom surface of the member and while the member is in an upside down state. The method may include tying laces of the skate while the blade of the skate is in the slot, while the skate rests on the top surface of the member, and while the member is in the right side up state.

DETAILED DESCRIPTION OF THE DRAWINGS

Figure 1A:
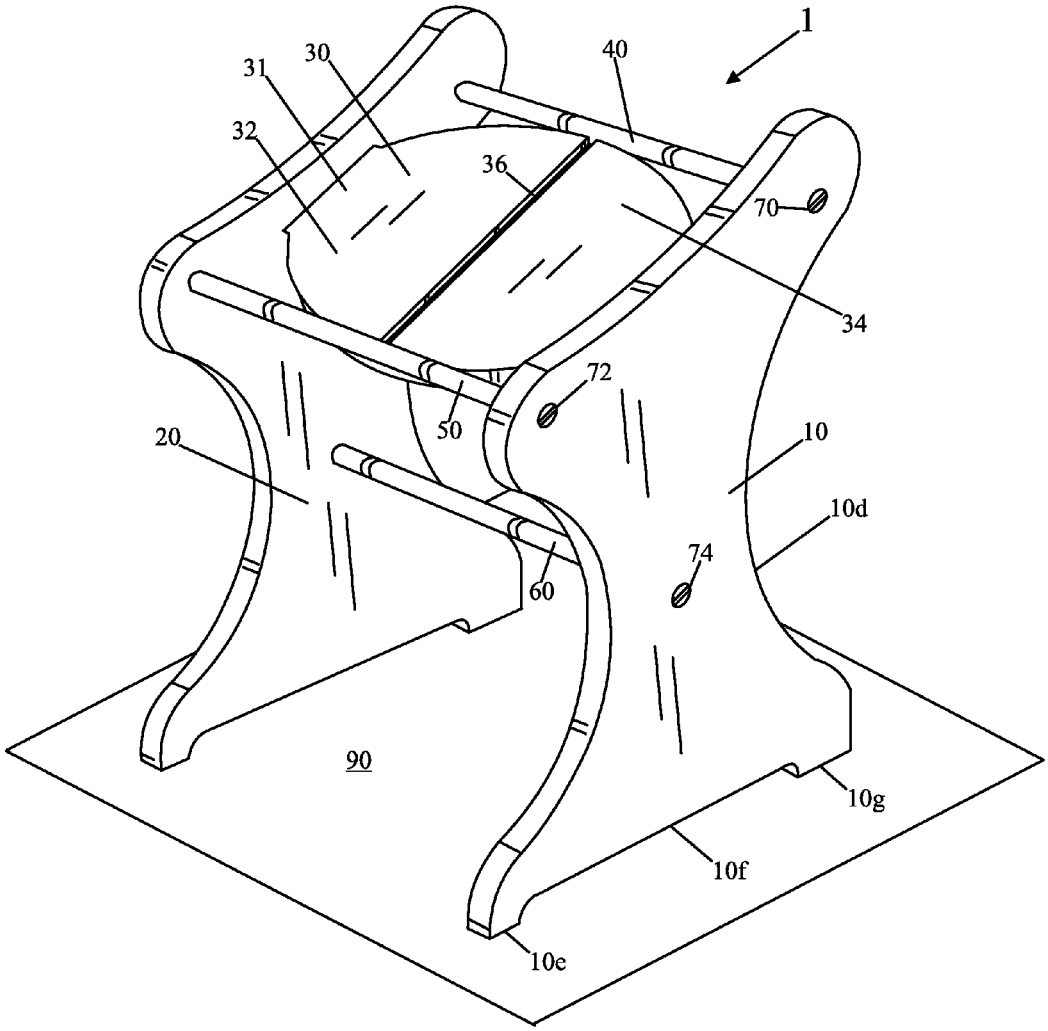
FIG. 1A shows a front top right side perspective view of an apparatus in accordance with an embodiment of the present invention, with the apparatus of FIG. 1A in a first state.
Figure 1B:
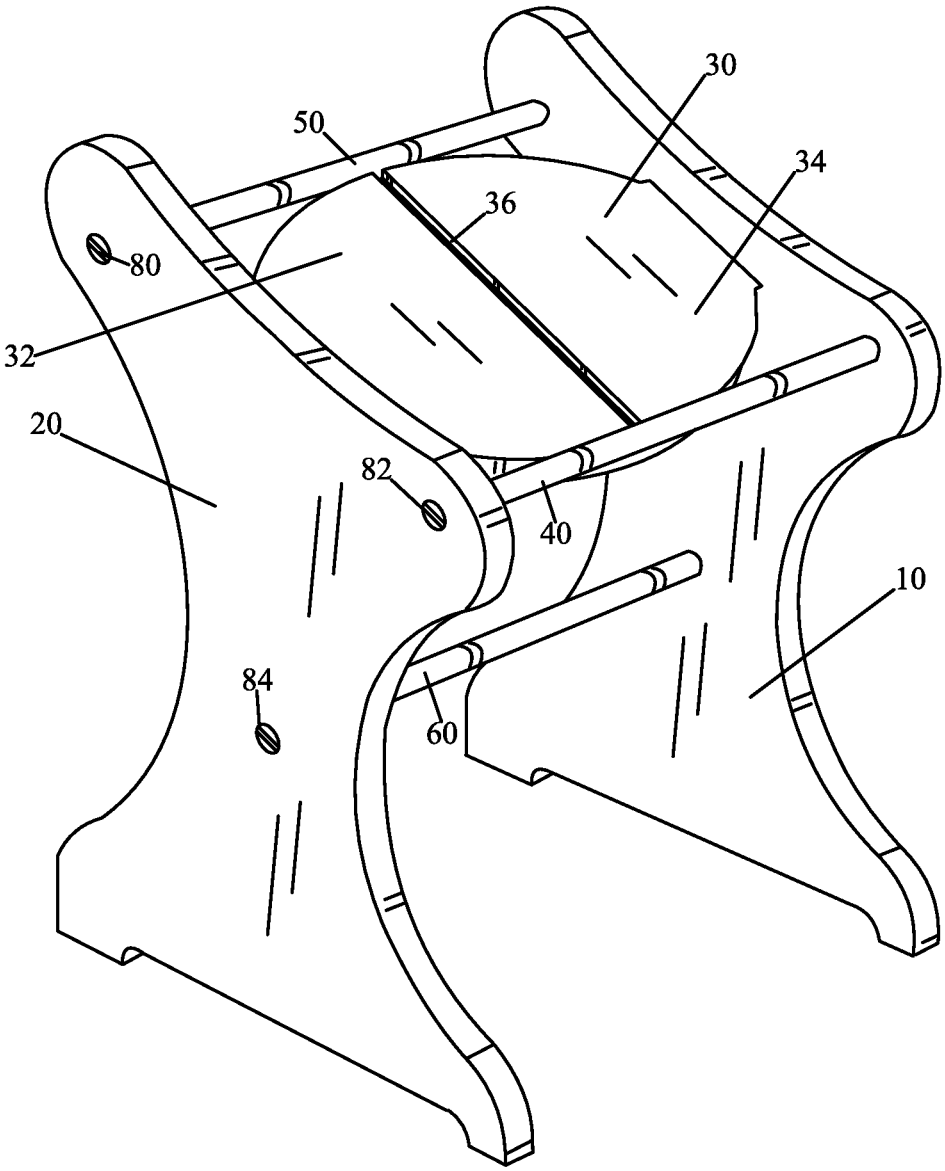
FIG. 1B shows a front top left side perspective view of the apparatus of FIG. 1A in accordance with an embodiment of the present invention, with the apparatus of FIG. 1A in a first state.
Figure 2A:
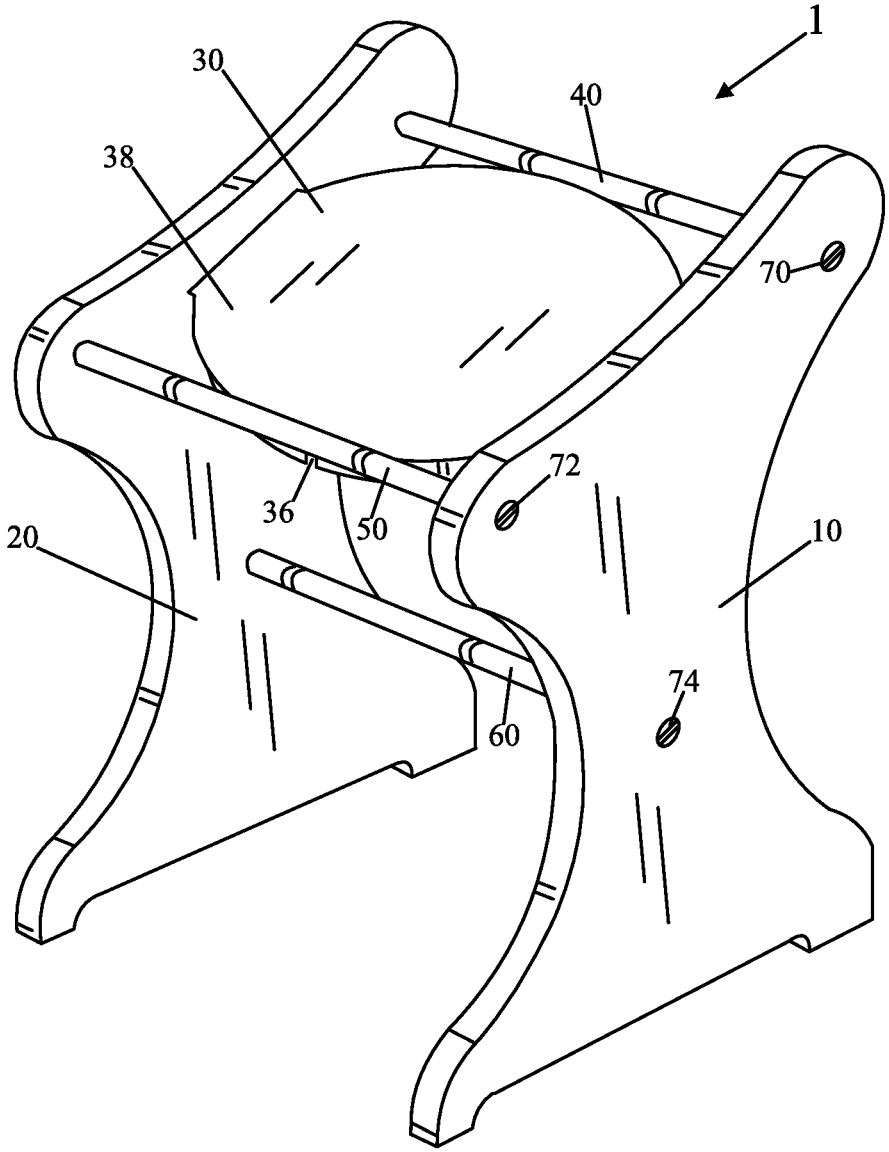
FIG. 2A shows a front top right side perspective view of the apparatus of FIG. 1A in accordance with an embodiment of the present invention, with the apparatus of FIG. 1A in a second state.
Figure 2B:
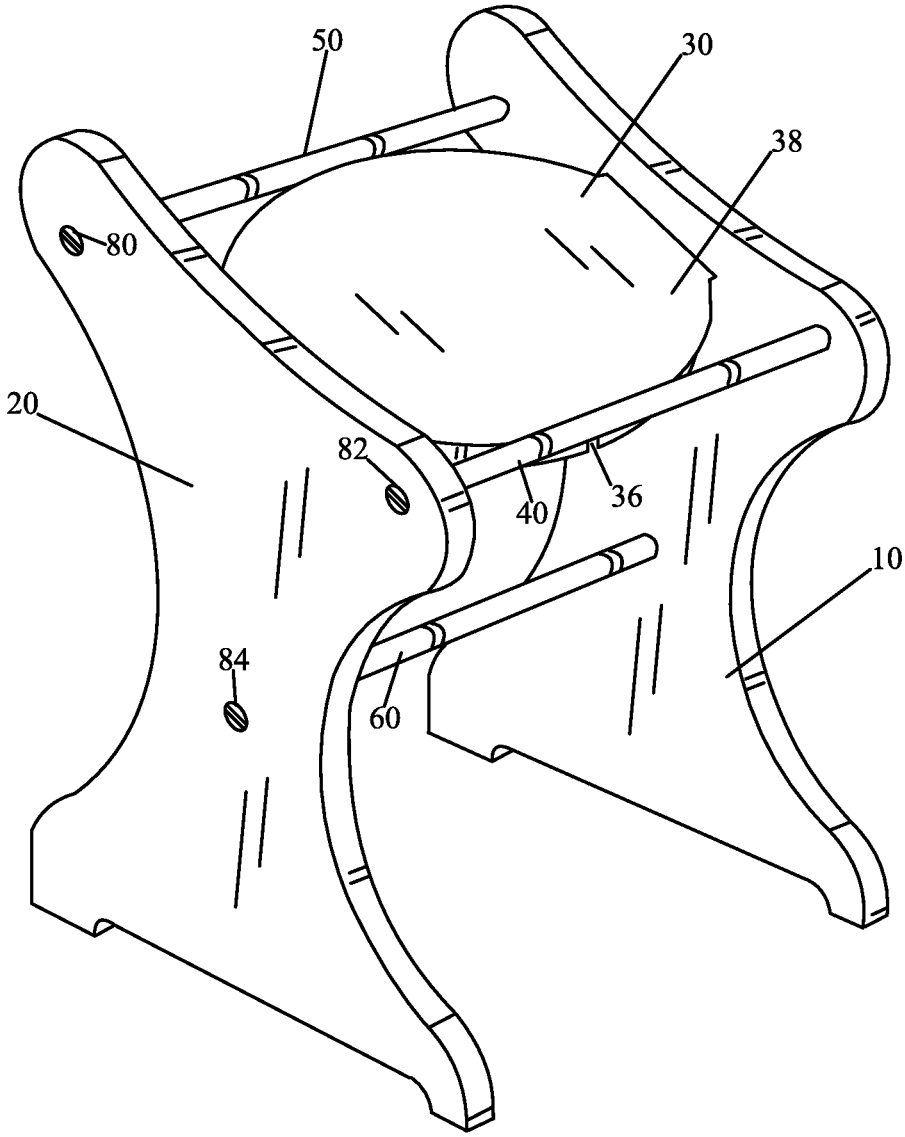
FIG. 2B shows a front top left side perspective view of the apparatus of FIG. 1A in accordance with an embodiment of the present invention, with the apparatus of FIG. 1A in a second state.
Figure 3A:
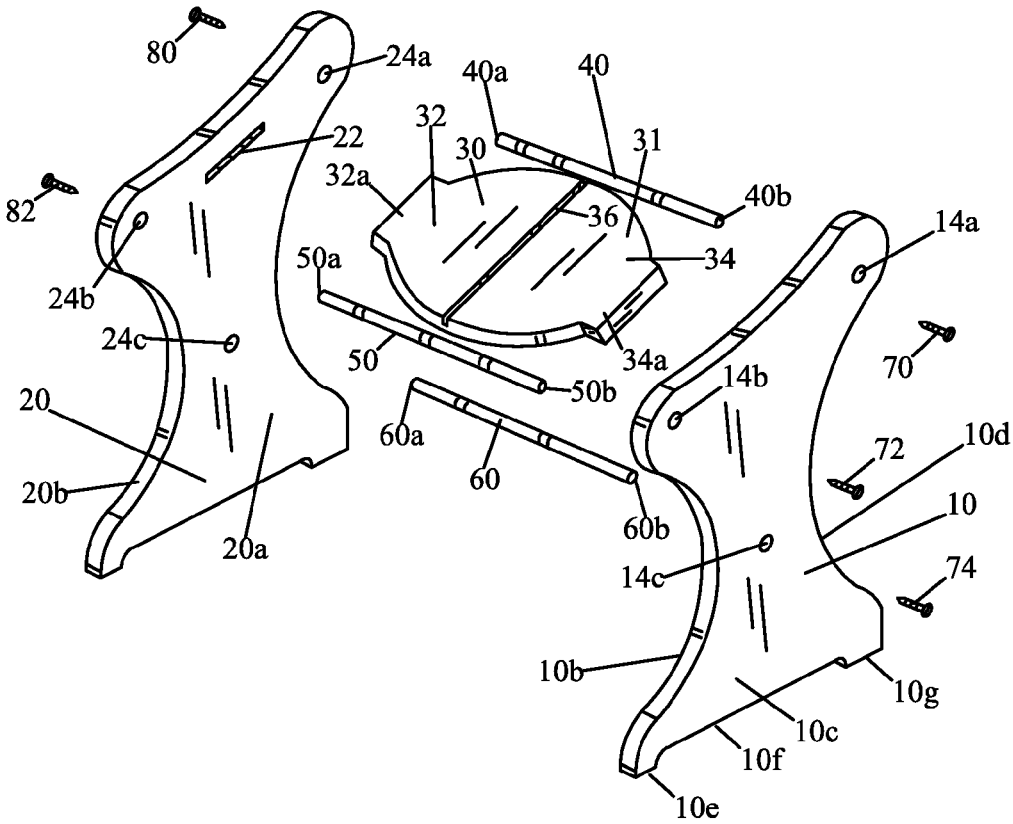
FIG. 3A shows a front top right side perspective view of the apparatus of FIG. 1A in accordance with an embodiment of the present invention, with the apparatus of FIG. 1A in a taken apart or disassembled state.
Figure 3B:
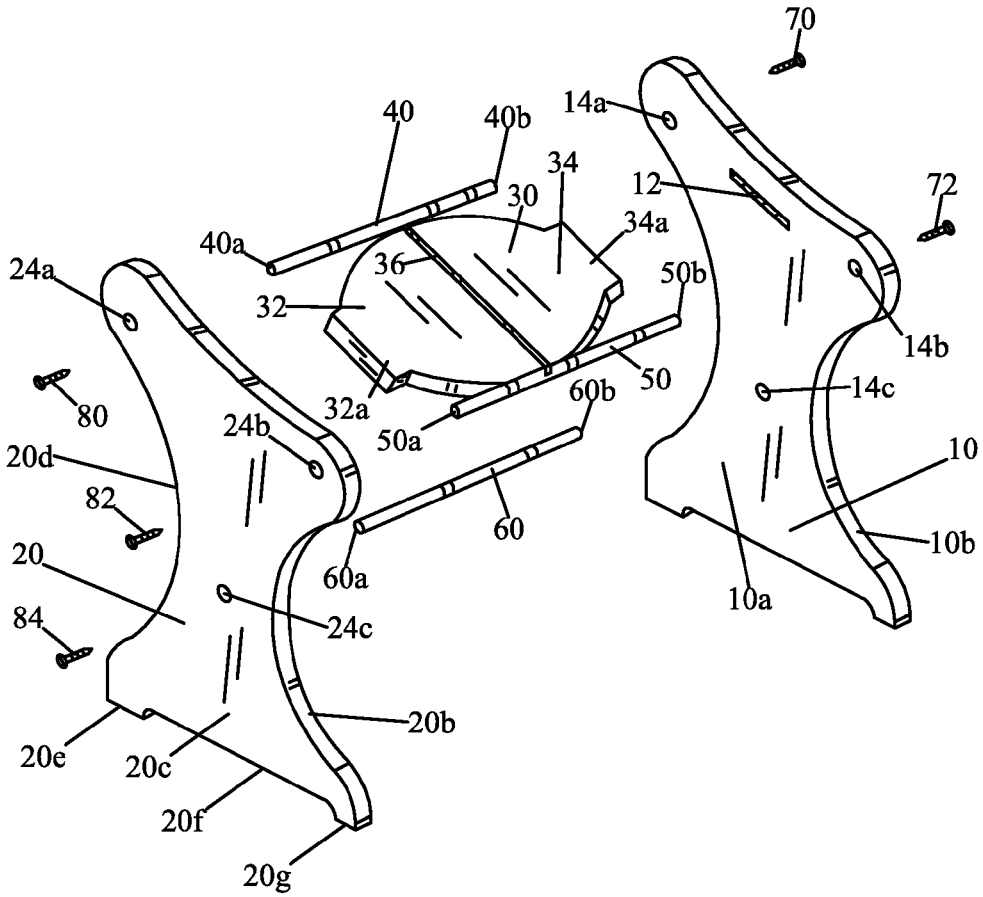
FIG. 3B shows a front top left side perspective view of the apparatus of FIG. 1A in accordance with an embodiment of the present invention, with the apparatus of FIG. 1A in a taken apart or disassembled state.
Figure 3C:
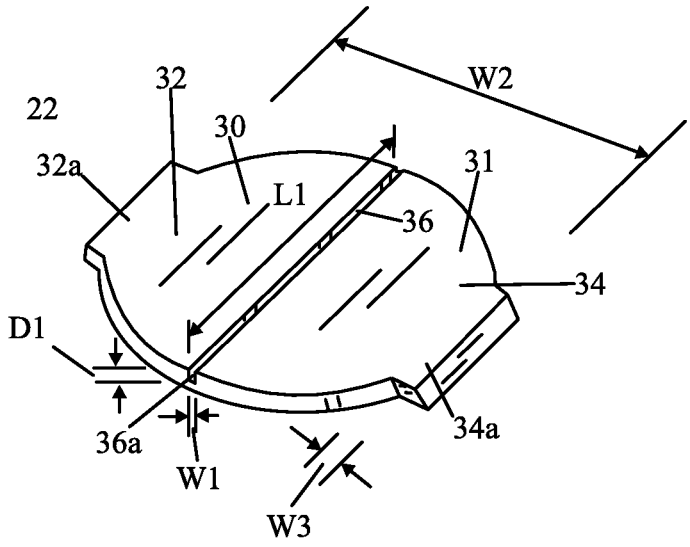
FIG. 3C shows a front top right side perspective view of a part of the apparatus of FIG. 1A.
Figure 4A:
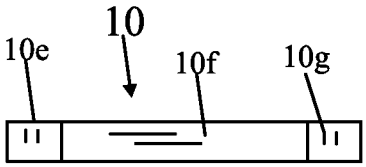
FIG. 4A shows a bottom view of a support of the apparatus of FIG. 1A.
Figure 4B:
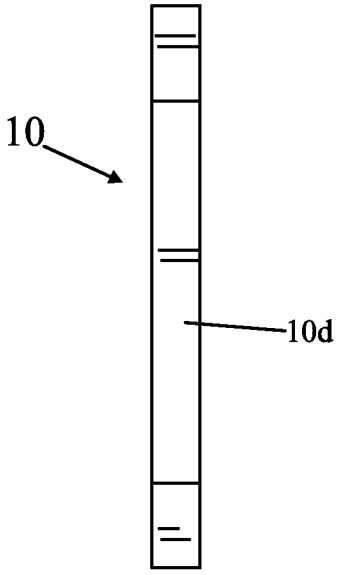
FIG. 4B shows a rear view of the support of FIG. 4A.

FIGS. 1A-B show front top right side perspective and front top left perspective views of an apparatus 1 in accordance with an embodiment of the present invention, with the apparatus 1 in a first state. FIGS. 2A-B show a front top right side perspective and front top left perspective views of the apparatus 1 in accordance with an embodiment of the present invention, with the apparatus 1 in a second state. FIGS. 3A-3B show a front top right side and front top left side perspective views of the apparatus 1 in a taken apart or disassembled state. FIG. 3C shows a front top right side perspective view of a member 30 of the apparatus 1 of FIG. 1A. FIG. 4A shows a bottom view of a support 10 of the apparatus 1. FIG. 4B shows a rear view of the support 10.

Referring to FIGS. 1A-4B, the apparatus 1 includes supports 10 and 20, the member 30, poles, posts, or rods 40, 50, and 60, screws 70, 72, and 74 (shown in FIG. 1A), and screws 80, 82, and 84 (shown in FIG. 1B).

The supports 10 and 20 may be entirely or substantially made of a rigid material capable of standing up and providing support, such as a hard wood, metal, or hard plastic. The support 10 may have openings 14*a*, 14*b*, and 14*c* into which ends 40*b*, 50*b*, and 60*b* of the rods 40, 50, and 60, respectively, can be inserted, as shown by FIG. 3A. The screws 70, 72, and 74 may be inserted and screwed into the ends 40*b*, 50*b*, and 60*b* of the rods 40, 50, and 60, through the openings

14*a*, 14*b*, and 14*c* as shown by FIG. 3A and FIG. 1A, in order to attach the rods 40, 50, and 60 to the support 10. In at least one embodiment the rods 40, 50, and 60 do not fit all the way through the openings 14*a*, 14*b*, and 14*c*, but rather only fit partially into the openings 14*a*, 14*b*, and 14*c*, respectively, and then screws 70, 72, and 74 are screwed as previously described.

The support 20 may have openings 24*a*, 24*b*, and 24*c* into which ends 40*a*, 50*a*, and 60*a* of the rods 40, 50, and 60, respectively, can be inserted, as shown by FIG. 3B. The screws 80, 82, and 84 may be inserted and screwed into the ends 40*a*, 50*a*, and 60*a* of the rods 40, 50, and 60, through the openings 24*a*, 24*b*, and 24*c* as shown by FIG. 3B and FIG. 1B, in order to attach the rods 40, 50, and 60 to the support 20. In at least one embodiment the rods 40, 50, and 60 do not fit all the way through the openings 24*a*, 24*b*, and 24*c*, but rather only fit partially into the openings 24*a*, 24*b*, and 24*c*, respectively, and then screws 80, 82, and 84 are screwed in, as previously described.

The support 10 also includes an inner surface 10*a*, edge surfaces 10*b* and 10*d*, and an outer surface 10*c* as shown by FIGS. 3A, 3B, and 4B. The support 10 also includes bottom foot surfaces 10*e* and 10*g*, and bottom surface 10*f* as shown by FIGS. 3A and 4A. The support 10 also includes a slot or indentation 12 as shown in FIG. 3B.

The support 20 also includes an inner surface 20*a*, an edge surfaces 20*b* and 20*d* and an outer surface 20*c* as shown by FIGS. 3A and 3B. The support 20 also includes bottom foot surfaces 20*e* and 20*g*, similar or identical to 10*e* and 10*g*, respectively, and bottom surface 20*f*, similar or identical to 10*f*, as shown by FIGS. 3A and 4A. The support 20 also includes a slot or indentation 22 as shown in FIG. 3A.

The member 30 may include a body portion 31 which is divided in half by a slot 36. The member 30 may have a top surface 32, a top surface 34, and a bottom surface 38. The member 30 may also include a protrusion 32*a* and a protrusion 34*a*. The member 30 including the body portion 31 and the protrusions 32*a* and 34*a* may be made of a hard rigid material such as a hard wood, plastic, or metal. The protrusion 32*a* can be inserted into the slot 22. The protrusion 34*a* can be inserted into the slot 12.

As shown in FIG. 3C, the slot 36 may have a length L1, which may be about seven and three quarters inches, or about the size of a length of an average shoe. The slot 36 may have a depth D1 which may be about three sixteenths (3/16) of an inch, and a width, W1, of about three sixteenths (3/16) of an inch. The member 30 has a body width W2 which may be about twelve inches and each of the protrusions 32*a* and 34*a* may have a width of W3 which is about one inch.

The rods 40, 50, and 60 may be cylindrical solid rods, posts or poles. The rods 40, 50, and 60 may be made entirely or substantially of a rigid material, such as a hard wood, metal or hard plastic.

The apparatus 1 can be taken apart, such as by loosening screws 70, 72, and 74, then the member 30 can be flipped over, and then the screws 70, 72, and 74 can be tightened to placed the apparatus 1 into the state of FIG. 2A. An individual can then place a typical shoe as shown in FIG. 6B, on the surface 38 and tie the shoe. A foot can also be placed on the surface 38 for a pedicure.

Figure 5A:
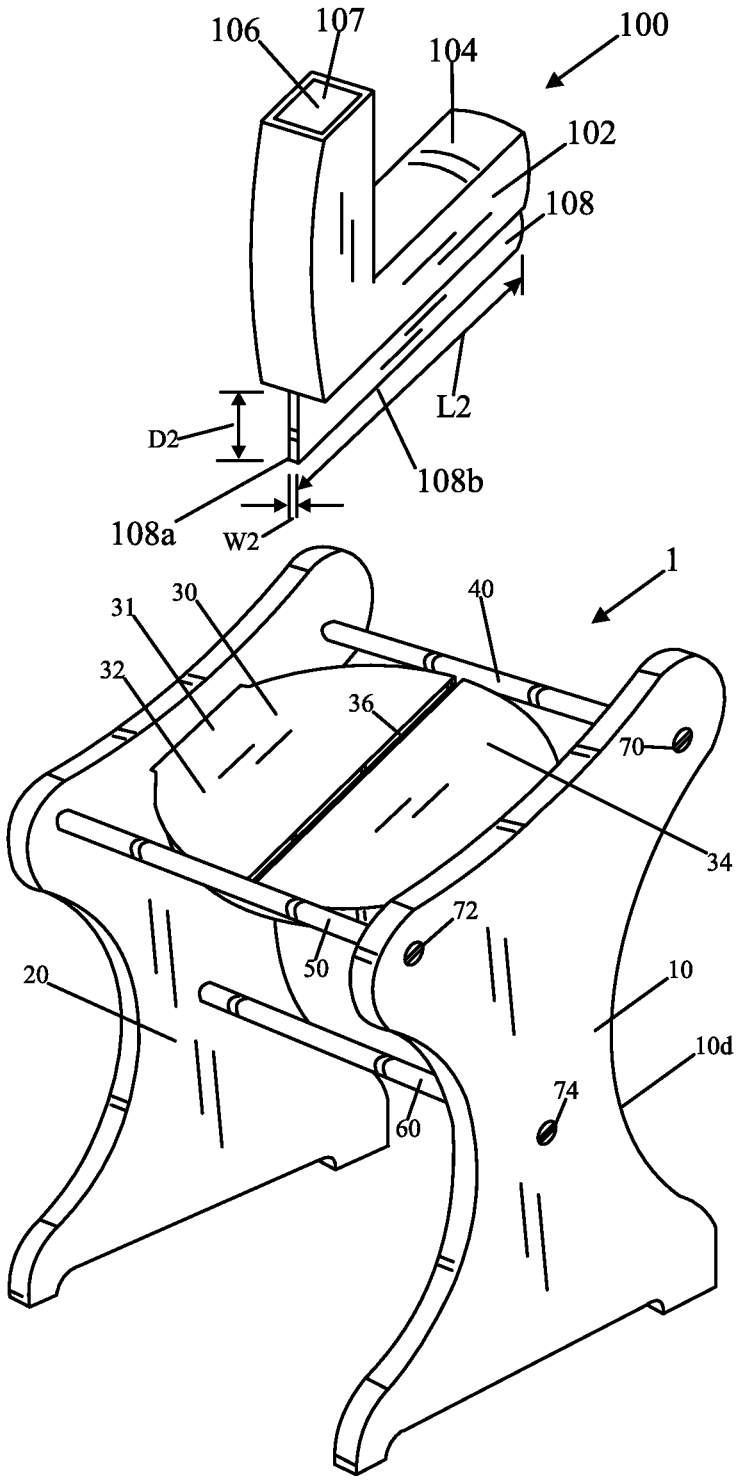
FIG. 5A shows a front top right side perspective view of the apparatus of FIG. 1A along with a skate having a blade not inserted into a slot of the apparatus of FIG. 1A, in accordance with an embodiment of the present invention, with the apparatus of FIG. 1A in the first state.

FIG. 5A shows a front top right side perspective view of the apparatus 1 along with an ice skate 100 having a blade 108 not inserted into a slot 36 of the apparatus 1, in accordance with an embodiment of the present invention, with the apparatus 1 of FIG. 1A in the first state. The skate 100 may be a typical known ice skate. The skate 100 may include laces 104, shown in simplified form, which can be used to tie together or lace up the skate 100. The skate 100 may include opening 106 into which a foot can be inserted to place the foot into a chamber 107 within a body portion 102 of the skate 100. The blade 108 may be attached to the body portion 102 of the skate 100. The blade 108 may have a length L2 which may be about twelve inches or any typical ice skate blade length. The blade 108 may have a depth D2 which may be about three inches or any typical ice skate blade depth. The blade 108 may have a width W2 which is typically slightly less than the width W1 of the slot 36 of the member 31 shown in FIG. 3C, so that the blade 108 can snugly fit into the slot 36.

Figure 5B:
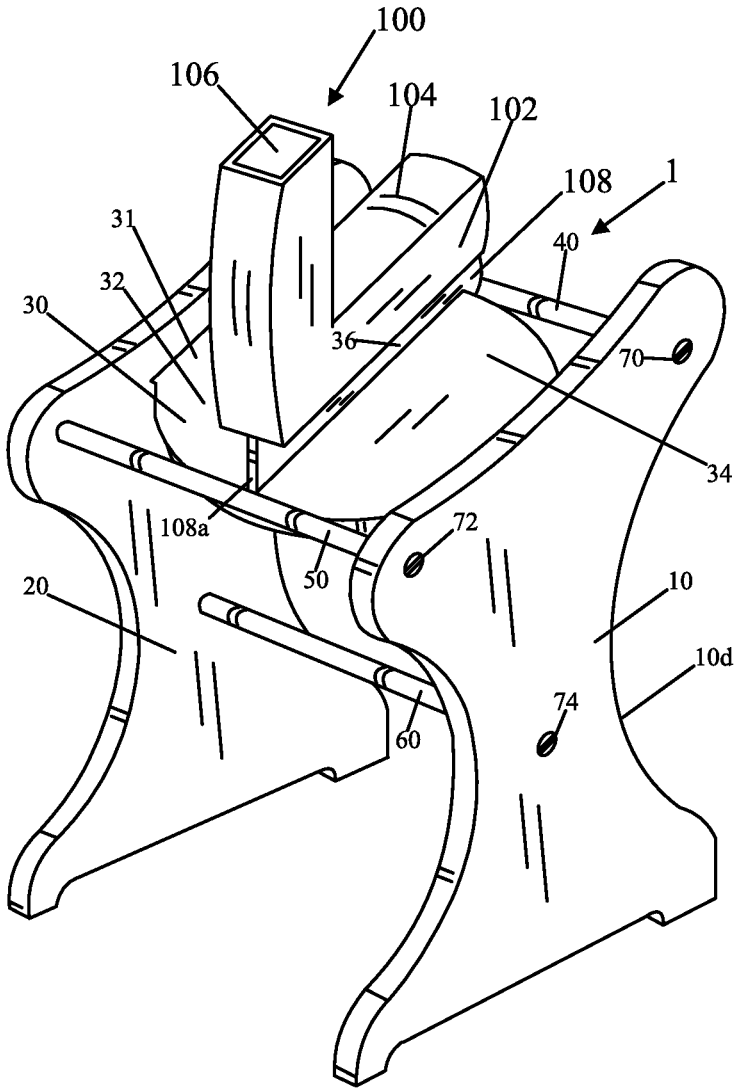
FIG. 5B shows a front top right side perspective view of the apparatus of FIG. 1A along with the skate having the blade, shown in FIG. 5A, wherein, in FIG. 5B, the blade has been inserted into the slot of the apparatus of FIG. 1A in accordance with an embodiment of the present invention, with the apparatus of FIG. 1A in the first state.

FIG. 5B shows a front top right side perspective view of the apparatus 1 of FIG. 1A along with the skate 100 having the blade 108, wherein, in FIG. 5B, the blade 108 has been inserted into the slot 36 of the apparatus 1 in accordance with an embodiment of the present invention, with the apparatus 1 of FIG. 1A in the first state. A person may place the blade 108 into the slot 36 as shown in FIG. 5B while the person's foot is in the chamber 107 of the body portion 102 of the skate 100. The person may then tie the laces 104 of the skate 100 to secure and/or tighten the skate 100 on the person's foot. As shown in FIG. 5B, the member or rod 50 of the apparatus 1, acts as a stop and contacts an end 108*a* of the blade 108, and prevents the blade 108 of the skate 100 from sliding off of the member 31. The apparatus 1 is configured so that blade 108 goes over member 40 but does not go over member 50, while a bottom surface 108*b*, whose location is shown by FIG. 5A, of the blade 108 is resting and contacting a substantial portion of or the entirety of a bottom surface 36*a* (location shown by FIG. 3) of the slot 36 and residing in the slot 36 as shown in FIG. 5B.

Figure 6A:
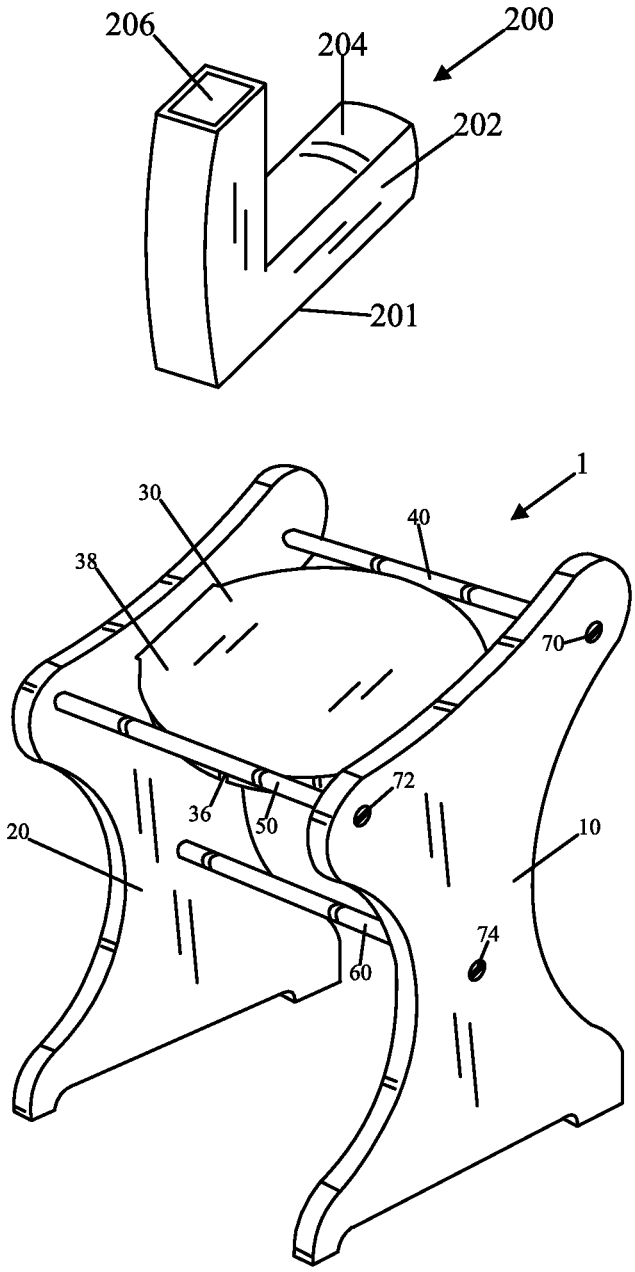
FIG. 6A shows a front top right side perspective view of the apparatus of FIG. 1A along with a shoe not placed onto the apparatus of FIG. 1A, in accordance with an embodiment of the present invention, with the apparatus of FIG. 1A in the second state.
Figure 6B:
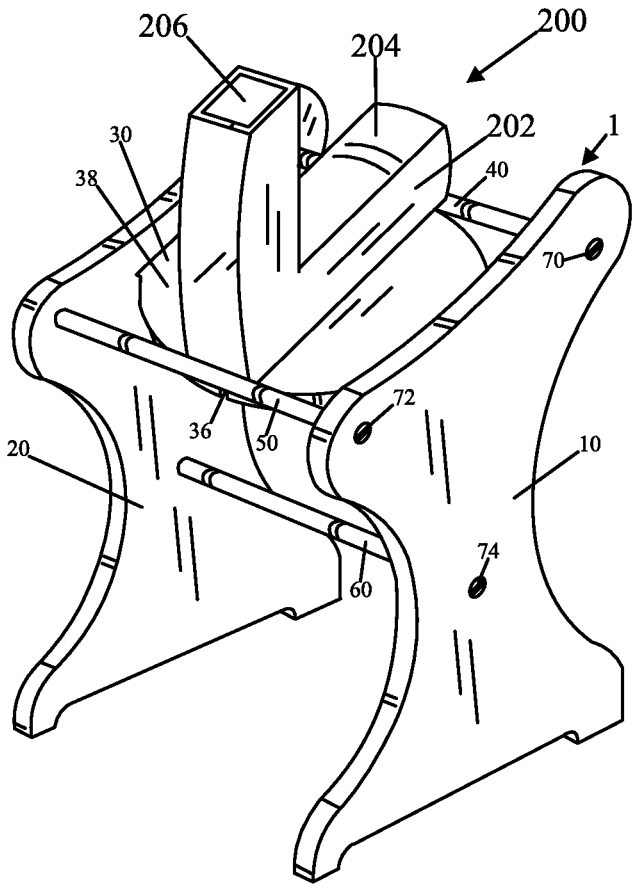
FIG. 6B shows a front top right side perspective view of the apparatus of FIG. 1A along with the shoe shown in FIG. 6A, wherein, in FIG. 6B, the shoe has been placed onto the apparatus of FIG. 1A in accordance with an embodiment of the present invention, with the apparatus of FIG. 1A in a second state.

FIG. 6A shows a front top right side perspective view of the apparatus 1 of FIG. 1A along with a shoe 200 not placed onto the apparatus 1 of FIG. 1A, in accordance with an embodiment of the present invention, with the apparatus 1 of FIG. 1A in the second state. FIG. 6B shows a front top right side perspective view of the apparatus 1 of FIG. 1A along with the shoe 200 shown in FIG. 6A, wherein, in FIG. 6B, the shoe 200 has been placed onto the apparatus 1 of FIG. 1A in accordance with an embodiment of the present invention, with the apparatus 1 of FIG. 1A in a second state. The shoe 200 may be any type of shoe. The shoe 200 may include body portion 202, and an opening 206, leading to a chamber 207 within body portion 202. The shoe 200 may also include shoe laces 204 which can be tied to secure and tighten the shoe 200. The shoe 200 may also include a sole or bottom surface 201 which can be placed on the surface 38 of the member 30 as shown by FIG. 6B, and then the laces 204 can be tied to tie the shoe 200. The member or rod 50 acts as a stop to prevent the shoe 200 from sliding off of the member 30. The shoe 200 goes over the rod 40 in FIG. 6B.

In at least one embodiment of the present invention, the member or board 30 is reversible. One side of the board or member 30 (on which are located surfaces 32, 34, and slot 36) allows the blade 108 of the skate 100 to rest in the slot 36 to permit comfortable lacing up of the laces 104 of the skate 100. In at least one embodiment foot board or member 30 comes out with the loosening of just three screws 70, 72, and 74. In other embodiments, a foot of a person can be placed on the member 30 in either the state of FIG. 1A or the state of FIG. 1B, and leggings or nylons can be pulled up on the person's leg.

The apparatus 1 can be used as a comfortable device for children to learn how to tie their shoes. A child, for example, can place their shoe (while it is on their foot) on the member 30 (on either surfaces 32, 34, and slot 36 or on opposite surface 38) and the angle of the member 30 allows the child to more easily see what they are tying. The member 30, and/or the surfaces 32, 34, and 38 may make an angle of thirty degrees with respect to a ground surface 90 on which the surfaces 10*e* and 10*g* rest as shown in FIG. 1A. Ground surface 90 is parallel to surfaces 10*e*, 10*f*, and 10*g*. as shown in FIG. 1A, and each of surfaces 32, 34, and 38 of member 30 may be at about an angle of thirty degrees with respect to ground surface 90.

In one or more embodiments, kids can put their foot in a shoe on the member 30 as shown in FIG. 6B, and parents can tie their shoe, such as shoe 200 from the other side of the member 30, i.e. from the side nearer rod 40 than rod 50 in FIG. 6B. This makes it easier to tie shoes of a child than kneeling down and a child sitting on the floor when the apparatus 1 is not used.

The apparatus 1 also can be used to have a foot massage performed on feet, without any shoes on the feet. Various footwear can be shoe 200 or can be replace shoe 200, and can be placed on the member 30, as in FIG. 6B. For example, golf shoes, ski boots, motocross boots, work boots, hiking boots, soccer cleats, ballet shoes, tap shoes, dress shoes, dress boots, and winter boots.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a member having a first end and a second end;

a first support; and a second support;

wherein the first support is connected to the first end of the member and holds up the first end of the member;

and the second support is connected to the second end of the member and holds up the second end of the member;

wherein the member has a top surface and a bottom surface;

wherein there is a slot running along the top surface of the member;

and wherein the slot is configured so that a blade of a skate fits snugly into the slot;

further comprising a first device which connects the first support with the second support;

wherein the first device is not part of the member;

wherein the first device is configured with respect to the slot so that the first device prevents the blade of the skate from sliding in a first direction in the slot when the blade is fit snugly in the slot; and wherein the member is configured to be disconnected from the first support and from the second support and placed in either a right side up state in which the top surface is showing or in an upside down state in which the bottom surface is showing.

2. The apparatus of claim 1 further comprising a plurality of devices which connect the first support with the second support, wherein the plurality of devices include the first device and a second device;

wherein the second device is not part of the member; and wherein the second device is configured with respect to the slot so that the second device does not prevent the blade of the skate from sliding in the slot when the skate is fit snugly in the slot.

3. The apparatus of claim 2 wherein each of the plurality of devices is a rod.

4. A method comprising the steps of:

placing a member in a right side up state;

connecting a first end of the member and supporting the first end of the member with a first support;

connecting a second end of the member and supporting the second end of the member with a second support;

connecting the first support with the second support through a first device which is not part of the member;

wherein the member has a top surface and a bottom surface;

wherein there is a slot running along the top surface of the member;

wherein the slot is configured so that a blade of a skate fits snugly into the slot; and wherein in the right side up state, the slot faces up; and wherein the first device is configured with respect to the slot so that the first device prevents the blade of the skate from sliding in a first direction in the slot when the blade is fit snugly in the slot; and further comprising disconnecting the member from the first support and from the second support; and placing the member in an upside down state in which the bottom surface is showing and the slot is not facing upwards.

5. The method of claim 4 further comprising connecting the first support with the second support with a plurality of devices, wherein the plurality of devices include the first device.

6. The method of claim 5 wherein each of the plurality of devices is a rod.

7. The method of claim 4 further comprising placing the blade of the skate in the slot and resting the skate on the member.

8. The method of claim 7 and further comprising tying laces of the skate.

9. The method of claim 4 and further comprising tying laces of a shoe while the shoe rests on the bottom surface of the member and while the member is in an upside down state.

10. The method of claim 9 and further comprising tying laces of the skate while the blade of the skate is in the slot, while the skate rests on the top surface of the member, and while the member is in the right side up state.

* * * * *